US005844380A

United States Patent [19]

Siepkes

[11] Patent Number: 5,844,380

[45] Date of Patent: Dec. 1, 1998

[54] CIRCUIT ARRANGEMENT FOR INGNITING AND SUPPLYING POWER TO A LAMP

[75] Inventor: Ronald Siepkes, Eindhoven, Netherlands

[73] Assignee: U.S. Philips Corporation, NY, N.Y.

[21] Appl. No.: 843,977

[22] Filed: Apr. 18, 1997

[30] Foreign Application Priority Data

May 10, 1996 [EP] European Pat. Off. ..... 96201279

[51] Int. Cl.[6] ..... G05F 1/00

[52] U.S. Cl. ..... 315/307; 315/225; 315/224; 315/209 R; 315/244; 315/DIG. 7

[58] Field of Search ..... 315/224, 225, 315/209 R, 127, 244, 307, 308, 291, 314, DIG. 5, DIG. 7

[56] References Cited

U.S. PATENT DOCUMENTS 5,089,751 2/1992 Wong et al. ..... 315/279
5,099,176 3/1992 Fellows et al. ..... 315/86
5,381,076 1/1995 Nerone ..... 315/209 R
5,463,284 10/1995 Mattas ..... 315/240
5,528,117 6/1996 Bwij et al. ..... 315/224

FOREIGN PATENT DOCUMENTS

0583838A2 2/1994 European Pat. Off. .

*Primary Examiner*—Benny Lee
*Assistant Examiner*—Haissa Philogene
*Attorney, Agent, or Firm*—Bernard Franzblau

[57] ABSTRACT

A circuit arrangement for igniting and supplying a discharge lamp by means of a substantially square-wave voltage at a frequency f1. It is possible to dim the lamp by adjusting the frequency of the substantially square-wave voltage to a value f2 which is different from f1. A protection circuit prevents damage to the lamp and to the circuit arrangement if the lamp current does not flow any more at the frequency f2.

10 Claims, 1 Drawing Sheet

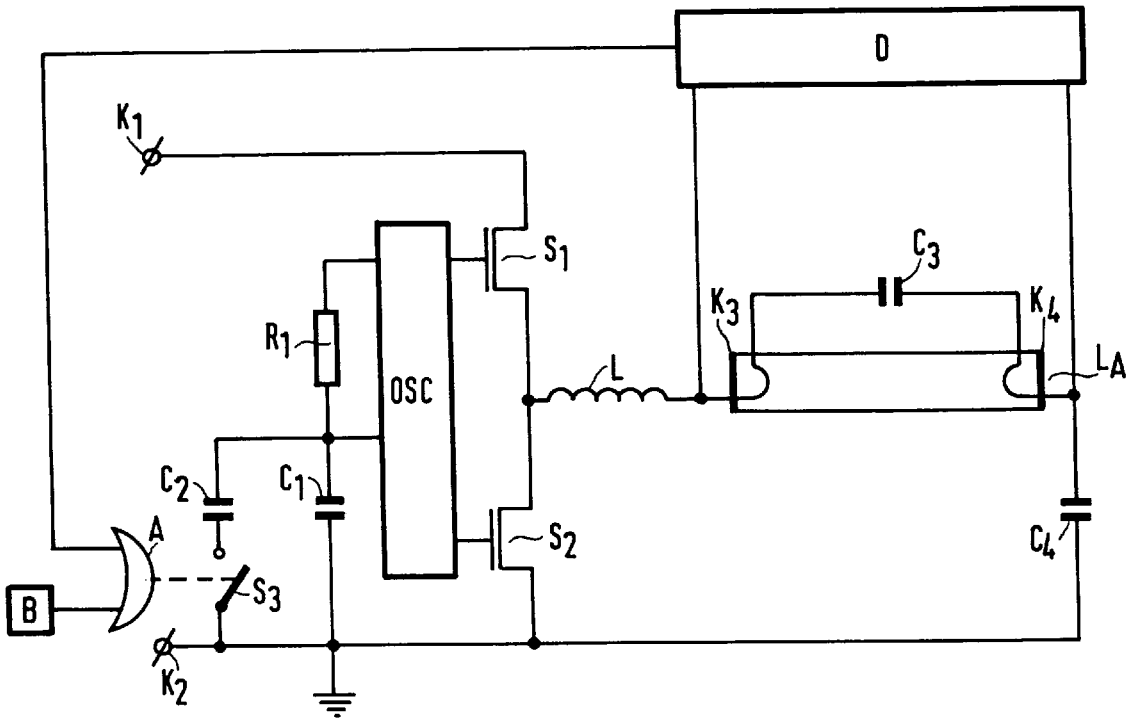
D
K1
S1
C3
K3
K4
R1
OSC
L
LA
C2
C1
A
S2
C4
S3
B
K2

CIRCUIT ARRANGEMENT FOR INGNITING AND SUPPLYING POWER TO A LAMP

BACKGROUND OF THE INVENTION

This invention relates to a circuit arrangement for igniting and supplying a lamp, comprising a DC-AC converter for generating a substantially square-wave AC voltage at a frequency f1 from a supply voltage, provided with input terminals for connection to a supply voltage source, a first branch comprising a switching element for interconnecting the input terminals, a control circuit coupled to a control electrode of the switching element and provided with means I for generating a first control signal for rendering the switching element conducting and non-conducting at the frequency f1, and a load branch coupled to the DC-AC converter and provided with an inductive element, a capacitive element, and terminals for holding a lamp, the resonance frequency of the load branch being chosen so as to lie in the range between nf1 and (n+1)f1, where n is an even integer.

Such a circuit arrangement is known from EP 0583838A2. The resonance frequency of the load branch is to be understood to be the resonance frequency when the lamp has not ignited. It is achieved through the choice of the resonance frequency as above that the lamp can be both ignited and operated in a stationary manner by means of the substantially square-wave AC voltage with the (constant) frequency f1. This means that the control circuit is comparatively simple and thus comparatively cheap. Often the dimensioning is chosen such that the DC-AC converter supplies power to the lamp, after the latter has ignited, which corresponds approximately to the rated lamp power. The luminous flux of the lamp is a maximum for such a consumed power. It is possible to set the luminous flux of the lamp to a lower value in that the frequency of the substantially square-wave AC voltage is changed, or in other words, in that the control circuit is provided with means II for generating a second control signal for rendering the switching element conducting and non-conducting at a frequency f2. If the means II comprise means for adjusting f2 over a range, the adjustment of the luminous flux of the lamp over a corresponding range will be possible. Alternatively, if the frequency f2 can be set for one or several discrete values, it is possible to set the luminous flux of the lamp to one or several corresponding discrete levels. A disadvantage of the presence of such means II in the circuit arrangement, however, is that the use of the second control signal may give rise to very high voltages across the lamp and/or parts of the circuit arrangement if the lamp has not yet ignited or does not conduct current owing to a defect. Such high voltages may also arise if no lamp is connected and may lead to damage or a reduced life of the lamp and/or the components from which the circuit arrangement was built up. The use of the second control signal may also be the cause of a very high power dissipation in the switching element of the DC-AC converter owing to capacitive operation.

SUMMARY OF THE INVENTION

The invention has for its object to provide a circuit arrangement as described in the openining paragraph with which the luminous flux of a lamp operated by means of the circuit arrangement can be set for at least two levels without the risk of the lamp and/or the circuit arrangement being damaged.

According to the invention, a circuit arrangement as described in the opening paragraph is for this purpose characterized in that the control circuit is in addition provided with means II for generating a second control signal for rendering the switching element conducting and non-conducting at a frequency f2, and with means III for deactivating the means II and activating the means I in dependence on the operational condition of the lamp.

If the control circuit generates a second control signal at a frequency f2 and the lamp is not conducting current (or is not present), this second control signal is replaced with the first control signal at the frequency f1 by the means Ill. Damage to the lamp and/or the components of the circuit arrangement is prevented thereby.

In a preferred embodiment of a circuit arrangement according to the invention, the resonance frequency of the load branch is chosen to lie in a range between 2f1 and 3f1.

It was found that very reliable embodiments of a circuit arrangement according to the invention can be realized when the means III are provided with means for generating a signal which is a measure for the amplitude of the voltage across the lamp.

It was also found to be advantageous when the DC-AC converter comprises a bridge circuit. It is possible in a comparatively simple manner to generate a substantially square-wave AC voltage by means of a bridge circuit.

It was found that a reliable and comparatively simple embodiment of the means I is possible through the use of an oscillator and first capacitive means. The first capacitive means are coupled to the oscillator and the capacitance of the first capacitive means determines the frequency at which the oscillator oscillates. This frequency also determines the value of frequency f1. The means II can be realized in a simple manner by means of the oscillator and second capacitive means in the case of such a construction of the means I. The second capacitive means are also coupled to the oscillator, and the capacitance of the second capacitive means determines the value of frequency f2.

The means III can be realized in a simple and reliable manner when they comprise a further switching element. The control circuit may be so constructed, for example, that the conductance state of this further switching element determines whether the first capacitive means or the second capacitive means are coupled to the oscillator.

BRIEF DESCRIPTION OF THE DRAWING

An embodiment of a circuit arrangement according to the invention will be explained in more detail with reference to a drawing, in which FIG. 1 is a diagram of an embodiment of a circuit arrangement according to the invention.

DETAILED DESCRIPTION OF THE PREFERRED EMBODIMENT

In FIG. 1, K1 and K2 are terminals for connection to a supply voltage source. The series arrangement of switching element S1 and switching element S2 connecting input terminal K1 to input terminal K2 forms a first branch. Switching element S2 is shunted by a load branch comprising a series arrangement of coil L, terminal K3, capacitor C3, terminal K4, and capacitor C4. Coil L and capacitor C3 in this embodiment form the inductive element and the capacitive element, respectively, of the load branch. Terminals K3 and K4 are terminals for holding a lamp, a discharge lamp La being connected to them. Terminals K3 and K4 are also connected to respective inputs of circuit portion D. Circuit portion D in this embodiment forms a means of generating a signal which is a measure for the amplitude of the voltage across the lamp La. An output of circuit portion D is connected to an input of OR-gate A. A further input of OR-gate A is connected to an output of circuit portion B. Circuit portion B in this embodiment forms the means by which a user can set the luminous flux to a maximum value or to a lower value. An output of OR-gate A is coupled to a control electrode of switching element S3. Switching element S3 in this embodiment forms a further switching element. A first main electrode of the further switching element S3 is connected to input terminal K2. A second main electrode of the further switching element S3 is connected to a first side of capacitor C2. A further side of capacitor C2 is connected to a common junction point of capacitor C1 and ohmic resistor R1. This common junction point is also connected to an input of oscillator OSC. A side of capacitor C1 facing away from said common junction point is connected to input terminal K2. A side of ohmic resistor R1 facing away from the common junction point is connected to a first output of oscillator OSC. A second output of oscillator OSC is connected to a control electrode of switching element S1. A third output of oscillator OSC is connected to a control electrode of switching element S2. Capacitor C1 and capacitor C2 in this embodiment together form first capacitive means. Capacitor C1 forms second capacitive means. The means I are formed by oscillator OSC, ohmic resistor R1, and capacitors C1 and C2. The means II are formed by oscillator OSC, capacitor C1, and ohmic resistor R1. The means III are formed by circuit portion D, OR-gate A, and further switching element S3. The control circuit is formed by circuit portion D, circuit portion B, OR-gate A, further switching element S3, capacitors C1 and C2, ohmic resistor R1, and oscillator OSC.

The operation of the embodiment shown in FIG. 1 is as follows.

Immediately after starting of the circuit arrangement, the output of circuit portion D is low and the output of circuit portion B is high. As a result of this the output of OR-gate A is high and the further switching element S3 is conducting. If input terminals K1 and K2 are connected to a supply voltage source, the control circuit will render the switching elements S1 and S2 alternately conducting and non-conducting with frequency f1. The value of frequency f1 is determined by the resistance value of ohmic resistor R1, the capacitance values of capacitors C1 and C2, and the oscillator OSC. As a result, a substantially squarewave voltage with frequency f1 is present across the load branch. The resonance frequency of the load branch in this embodiment was chosen to lie between 2f1 and 3f1 so that the third harmonic of this substantially square-wave voltage with frequency f1 generates a voltage of such a high amplitude across the lamp La that this lamp La ignites. After ignition, the frequency of the control signal is maintained at f1 , so that an alternating current at the frequency fl flows through the lamp La. The luminous flux of the lamp La has the maximum adjustable value at this alternating current with frequency f1. A user of the circuit arrangement may make the output of circuit portion B and thus also the output of OR-gate A low, so that the further switching element S3 becomes non-conducting. If a user selects this possibility, the frequency f2 of the control signal now generated by the control circuit is no longer partly determined by capacitor C2, but exclusively by oscillator OSC, the resistance value of ohmic resistor R1, and the capacitance of capacitor C1. The result is that frequency f2 is higher than frequency f1. Since the frequency of the substantially square-wave voltage across the load branch also rises from f1 to f2, the amplitude of the lamp current decreases. Accordingly, the luminous flux of the lamp is reduced to the lower adjustable value. If the lamp is removed from the terminals K3 and K4 now, however, or stops conducting current owing to a defect, very high voltages could be generated between terminals K3 and K4 as well as in other locations in the circuit arrangement if the means III were absent. The power dissipation in the switching elements S1 and S2 could also rise strongly as a result of capacitive switching. In the circuit arrangement shown in FIG. 1, however, the output of circuit portion D becomes high as a result of the high voltage obtaining between the inputs of circuit portion D. Since the output of circuit portion D becomes high, the output of OR-gate A also becomes high, so that the further switching element S3 becomes conducting. The frequency of the control signal generated by the control circuit is again partly determined by the capacitance of capacitor C2, and accordingly drops to the value f1. The result of this is that excessively high voltages are not generated between terminals K3 and K4 nor in other locations in the circuit arrangement, while at the same time no unacceptably great power dissipation takes place in the switching elements S1 and S2.

I claim:

1. A circuit arrangement for igniting and supplying a lamp, comprising:

a DC-AC converter for generating a substantially square-wave AC voltage at a frequency f1 from a supply voltage, the DC-AC converter including input terminals for connection to a supply voltage source, a first branch comprising a switching element which interconnects the input terminals, and a control circuit coupled to a control electrode of the switching element and provided with means I for generating a first control signal for rendering the switching element conducting and non-conducting at the frequency f1, and a load branch coupled to the DC-AC converter and including an inductive element, a capacitive element, and terminals for holding a lamp, the resonance frequency of the load branch being chosen so as to lie in the range between nf1 and (n+1)f1, where n is an even integer, wherein the control circuit further comprises means II for generating a second control signal for rendering the switching element conducting and non-conducting at a frequency f2, and means III for deactivating the means II and activating the means I dependent upon the operational condition of the lamp.

2. A circuit arrangement as claimed in claim 1, wherein the resonance frequency of the load branch is chosen to lie in a range between 2f1 and 3f1.

3. A circuit arrangement as claimed in claim 1, wherein the DC-AC converter comprises a bridge circuit.

4. A circuit arrangement as claim 1, wherein the means I comprise an oscillator and first capacitive means.

5. A circuit arrangement as claimed in claim 4, wherein the means II comprise the oscillator and second capacitive means.

6. A circuit arrangement as claimed in claim 5, wherein the means III comprise a further switching element.

7. A circuit arrangement as claimed in claim 1, wherein the means III comprise means for generating a signal which is a measure of the amplitude of the voltage across the lamp.

8. A circuit arrangement as claimed in claim 2, wherein the DC-AC converter comprises a bridge circuit.

9. A circuit arrangement as claimed in claim 2, wherein the means I comprise an oscillator and first capacitive means.

10. A circuit arrangement as claimed in claim 3, wherein the means I comprise an oscillator and first capacitive means.

* * * * *